US008307641B2

(12) United States Patent
Hanks et al.

(10) Patent No.: US 8,307,641 B2
(45) Date of Patent: Nov. 13, 2012

(54) MACHINE HAVING SELECTIVE RIDE CONTROL

(75) Inventors: Benjamin J. Hanks, Leicester (GB); Andrew J. Smith, Ashbourne (DE)

(73) Assignee: Caterpillar Inc., Peoria, IL (US)

( * ) Notice: Subject to any disclaimer, the term of this patent is extended or adjusted under 35 U.S.C. 154(b) by 905 days.

(21) Appl. No.: 12/314,876

(22) Filed: Dec. 18, 2008

(65) Prior Publication Data

US 2009/0158726 A1 Jun. 25, 2009

(30) Foreign Application Priority Data

Dec. 21, 2007 (EP) ..... 07150379

(51) Int. Cl.
*E02F 9/00* (2006.01)
*F15B 1/02* (2006.01)

(52) U.S. Cl. ..... 60/469; 60/416

(58) Field of Classification Search ..... 60/413, 60/416, 469

See application file for complete search history.

(56) References Cited

U.S. PATENT DOCUMENTS 5,992,146 A * 11/1999 Hausman ..... 60/413
6,151,874 A * 11/2000 Eis ..... 60/413
6,167,701 B1 * 1/2001 Hatcher et al. ..... 60/416
6,748,738 B2 * 6/2004 Smith ..... 60/414
6,951,103 B2 * 10/2005 Berthod et al. ..... 60/413
7,444,809 B2 * 11/2008 Smith et al. ..... 60/414
7,621,124 B2 * 11/2009 Mizoguchi et al. ..... 60/469
2003/0213238 A1 11/2003 Smith
2004/0006980 A1 1/2004 Berthod et al.
2006/0101815 A1 * 5/2006 Kobayashi et al. ..... 60/413
2007/0186548 A1 8/2007 Smith et al.

FOREIGN PATENT DOCUMENTS

JP 06 264467 9/1994
JP 06264467 A * 9/1994
WO WO 2005035883 A1 * 4/2005

OTHER PUBLICATIONS

European Search Report and European Search Opinion included in an EPO communication dated May 27, 2008, in corresponding EP Application No. 07150379.1 (8 pages).

* cited by examiner

*Primary Examiner* — Thomas E Lazo
(74) *Attorney, Agent, or Firm* — Finnegan, Henderson, Farabow, Garrett & Dunner LLP

(57) ABSTRACT

A machine is provided with a first work arm, at least one first cylinder having a first lift chamber configured for receiving pressurized fluid so as to lift the first work arm, and a first accumulator associated with the first lift chamber of the first cylinder. The machine further includes a second work arm, at least one second cylinder having a second lift chamber configured for receiving pressurized fluid so as to lift the second work arm, and a second accumulator associated with the second lift chamber of the second cylinder. A control arrangement is provided for selectively fluidly connecting one or both of the first and second accumulators with the associated first and second lift chambers.

24 Claims, 3 Drawing Sheets

MACHINE HAVING SELECTIVE RIDE CONTROL

This application claims the priority benefit of European Patent Application No. 07150379.1, filed Dec. 21, 2007.

TECHNICAL FIELD

This disclosure relates to ride control and, in particular, but not exclusively, to machines having selective ride controls.

BACKGROUND

Mobile machines, for example those equipped with a work arm, may be provided with systems known as ride control. Such systems commonly fluidly connect a hydraulic accumulator to a hydraulic cylinder provided to support the work arm. During movement of the machine fluid can transfer between the cylinder and the accumulator allowing for a travel of the work arm relative to the rest of the machine. By providing such arrangement it is found that a fore/aft rocking movement of the machine may be reduced as the ride control will absorb some of the energy created by the inertial forces between the work arm and the rest of the machine.

From U.S. Pat. No. 5,992,146, a variable rate ride control system is known in which an accumulator arrangement is connected through a first valve mechanism to the loaded end of an actuator to provide a cushion or damping of the sudden changes in force. The first valve mechanism controls the magnitude of the damping in response to the rate of flow between the actuator and the accumulator arrangement via an infinitely variable flow control mechanism. However, the system is fairly costly, requires complex controls and provides only limited selectivity.

The current disclosure aims to improve upon some or all of the disadvantages associated with the prior art.

SUMMARY

In a first aspect there is disclosed a machine having a first work arm, at least one first cylinder having a first lift chamber configured for receiving pressurized fluid so as to lift the first work arm and a first accumulator associated with the first lift chamber of the first cylinder. The machine further includes a second work arm, at least one second cylinder having a second lift chamber configured for receiving pressurized fluid so as to lift the second work arm and a second accumulator associated with the second lift chamber of the second cylinder. A control arrangement is provided for selectively fluidly connecting one or both of the first and second accumulators with the associated first and second lift chambers.

In a second aspect there is disclosed a method of operating a machine having a first work arm associated with a first lift chamber of a first cylinder for lifting the first work arm. The first lift chamber of the first cylinder is selectively fluidly connectable to a first accumulator via a first fluid line. The machine further includes a second work arm associated with a second lift chamber of a second cylinder for lifting the second work arm, the second lift chamber of the second cylinder being selectively fluidly connectable to a second accumulator via a second fluid line. The method includes opening the first fluid line between the first lift chamber of the first cylinder and the first accumulator, opening the second fluid line between the second lift chamber of the second cylinder and the second accumulator and moving the machine in a selected direction.

Other features and aspects of this disclosure will be apparent from the following description and the accompanying drawings.

DETAILED DESCRIPTION

Figure 1:
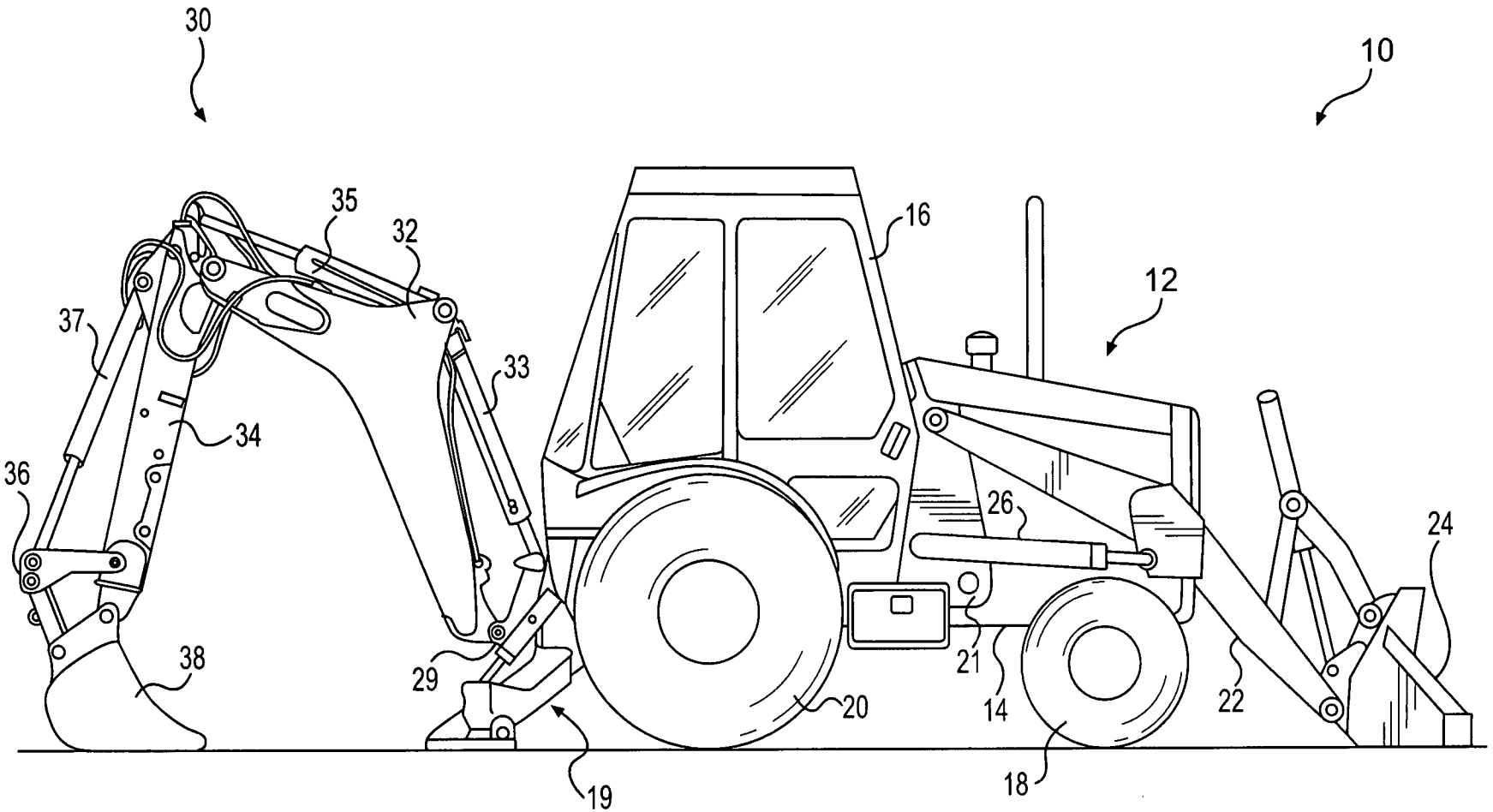
FIG. 1 is a representation of an exemplary machine suitable for being provided with ride control.

Referring to FIG. 1, an embodiment of the current disclosure is shown in context of a construction machine known as a backhoe loader. It is to be understood however that the embodiment of FIG. 1 is exemplary only and that the concept is equally applicable to any other suitable machine. The machine 10 may have a body 12. The body 12 may be a single piece or may include a set of subassemblies and or components. For example, the body 12 may include a frame 14, an operator platform 16, a pair of front wheels 18, a pair of rear wheels 20 and a stabilizing arrangement 19. The body 12 may provide a first connection 21 for connecting a first work arm 22. The first work arm 22 may be a front mounted loader arm provided with any suitable attachment 24, such as, for example, a work tool like a bucket. The first work arm may be lifted and lowered via the first cylinder 26. It is to be understood that the first cylinder 26 may be read as at least one first cylinder 26 as there may be a plurality of first cylinders 26, for example two first cylinders 26, one at either side of the body 12. The operation of the first cylinder 26 will be discussed in more detail later on.

The body 12 may further provide a second connection 29 for connecting a second work arm generally designated with the numeral 30. The second work arm 30 may be mounted at, or adjacent to, a rear end of the machine 10 and may, for example, include a boom 32, a stick 34, and a linkage 36 for connecting to any suitable attachment 38, for example, a work tool such as a bucket. The second work arm 30 may be lifted and lowered by a second cylinder 33 connected between the body 12 and the boom 32. The operation of the second cylinder 33 will be discussed in more detail later on. The relative orientation of the boom 32, the stick 34 and linkage 36 may be altered by using a third cylinder 35 between the boom 32 and the stick 34 and a fourth cylinder 37 between the stick 34 and linkage 36. Again it is to be understood that each of the cylinders 33, 35 and 37 may in fact be a plurality of similar cylinders performing a similar function.

Figure 2:
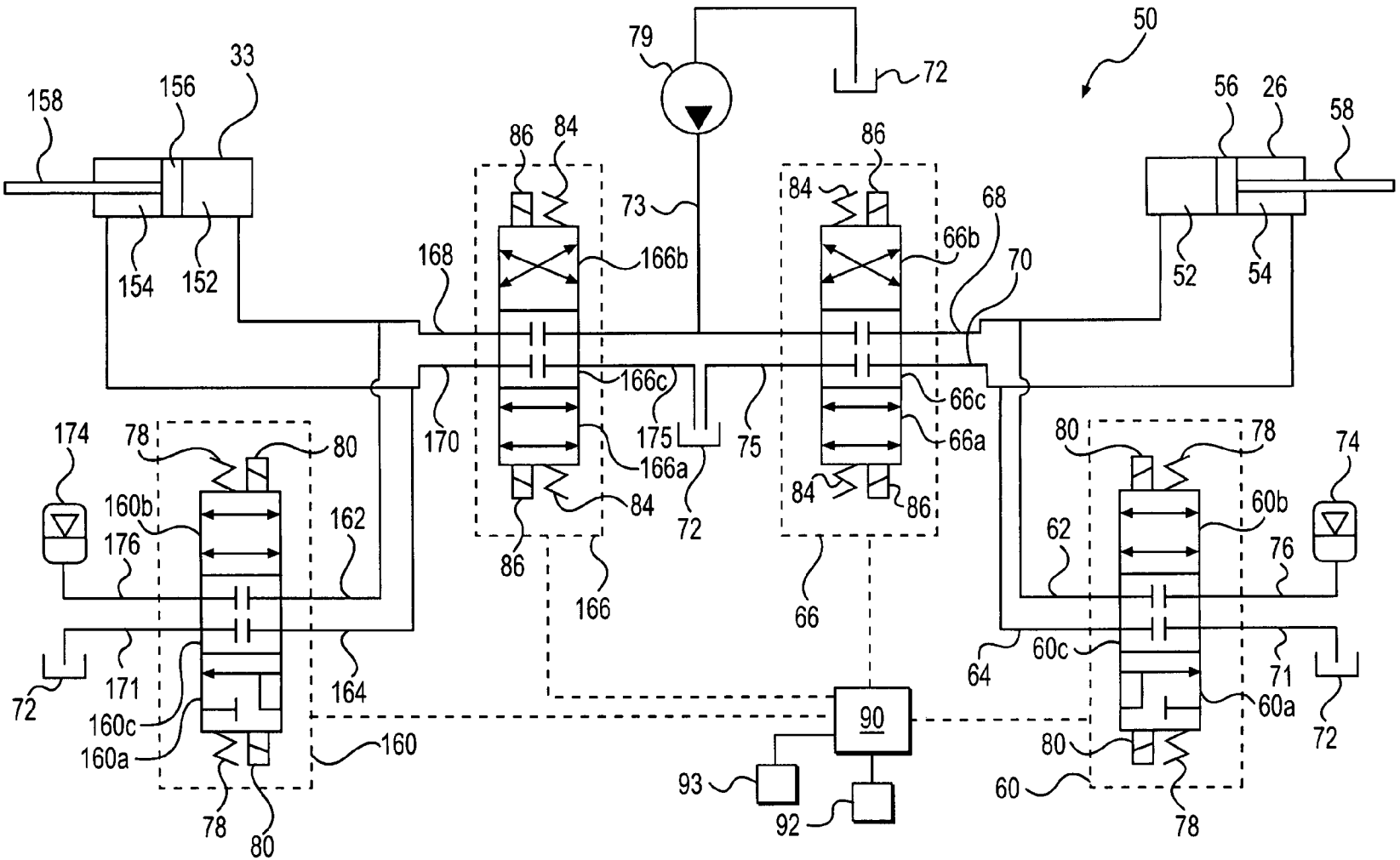
FIG. 2 is an exemplary schematic representation of a fluid system for the machine of FIG. 1.

The first cylinder 26 may be configured to operate and hence lift and lower the first work arm 22. The first cylinder 26 may be part of a fluid system generally designated 50 of which an exemplary embodiment is shown in FIG. 2. The fluid system 50 also includes an exemplary embodiment of the fluid circuit relating to the second cylinder 33. As the circuits for the first and second cylinders 26 and 33 may be substantially similar in concept only the circuit leading to the first cylinder 26 will be discussed in more detail. Like elements in both circuits for the first and second cylinders 26 and 33 will have like numbering. Where necessary to distinguish, similar components in the circuits for the first or second cylinders 26, 33 will for convenience accordingly be named first and second respectively.

The first cylinder 26 may have a lift chamber 52 and a lowering chamber 54 and may be provided with a piston 56 and a rod 58. The first cylinder 26 may operate in a conventional manner such that when the lift chamber 52 is pressurized the first cylinder 26 is extended and when the lowering chamber 54 is pressurized the first cylinder 26 is retracted. Although shown in FIG. 1 as having the rod end of the first cylinder 26 attached to the first work arm 22, the first cylinder 26 may also be arranged such that the head end of the first cylinder 26 is attached to the first work arm 22.

The lift chamber 52 of the first cylinder 26 may be fluidly connected to a ride control valve 60 via a fluid line 62. The lowering chamber 54 may be fluidly connected to the ride control valve 60 via a fluid line 64. The lift chamber 52 may further be connected to a directional valve 66 via a fluid line 68. The lowering chamber 54 may further be fluidly connected to the directional valve 66 via a fluid line 70. The fluid lines 62 and 68 may be partially combined into a single fluid line as shown in FIG. 2, but they may also be run separately. Similarly, the fluid lines 64 and 70 may be partially combined into a single fluid line as shown in FIG. 2, but they may also be run separately.

The ride control valve 60 may further be fluidly connected to a low pressure region 72 via a fluid line 71. The low pressure region 72 may be of any suitable type and may for example be a fluid reservoir or a set of either interlinked or independent fluid reservoirs. The ride control valve 60 may further be connected to an accumulator 74 via a fluid line 76. The accumulator 74 may be a conventional accumulator having a pre-charged and compressible gas chamber filled with a gas such as nitrogen. The accumulator 74 may also be an arrangement of multiple accumulators. In an embodiment the first and second accumulators 74 and 174 may be shared by both the first and second cylinders 26 and 33. In an embodiment the first and second accumulators 74 and 174 may be a single accumulator shared by both the first and second cylinders 26 and 33.

In an embodiment, machine 10 may include a first and second ride control valves 60 and 160. In another embodiment, first and second ride control valves 60 and 160 may be the same valve. The ride control valve 60 may include a single valve or an arrangement of valves. The ride control valve 60 may be controlled in any suitable manner and may for example be biased to one position by springs 78 and actuated by actuators 80. The actuators 80 may be solenoids.

In the exemplary embodiment of FIG. 2, the ride control valve 60 may be configured to assume a plurality of positions and may therefore be provided with first, second and third portions 60*a*, 60*b* and 60*c* representing first, second and third valve positions. In other embodiments the fluid system 50 may be simplified by omitting either portion 60*a* or portion 60*b*.

By selecting a first position of the ride control valve 60 and thereby using the first portion 60*a*, a lift chamber 52 is fluidly connected to both the first accumulator 74 and a lowering chamber 54. In the second position, the active portion of the valve arrangement 60 is portion 60*b*. By selecting portion 60*b*, the ride control valve 60 fluidly connects the lift chamber 52 to the accumulator 74. Simultaneously the lowering chamber 54 is fluidly disconnected from the accumulator 74. The ride control valve 60 may be configured such that the lowering chamber 54 is fluidly connected to the low pressure region 72 when the ride control valve 60 is in the second position, but the ride control valve 60 may alternatively be configured to fluidly disconnect the lowering chamber 54 from the low pressure region 72.

By selecting a third position of the valve arrangement 60 and thereby using the third portion 60*c*, the lift and lowering chambers 52 and 54 are both disconnected from the accumulator 74. In the third position, the lift and lowering chambers 52 and 54 may be either fluidly connected to one another or they may be fluidly disconnected from one another.

A directional valve 66 may further be fluidly connected to the low pressure region 72 via a fluid line 75. The directional valve 66 may further be connected to a source of pressurized fluid 79 via a fluid line 73. The source of pressurized fluid 79 may, for example, be a fluid pump or multiple fluid pumps that may be either interlinked or operated independently from one another.

The directional valve 66 may be configured to pressurize at least one of the lift and lowering chambers 52 and 54 of the first cylinder 26 to, for example, lift and lower the first work arm 22.

The directional valve 66 may include a single valve or a combination of valves. The directional valve 66 may be controlled in any suitable manner and may, for example, be biased to one position by springs 84 and actuated by actuators 86. The actuators 86 may be solenoids.

In the exemplary embodiment of FIG. 2, the directional valve 66 may be configured to assume a plurality of positions and may therefore be provided with first, second and third portions 66*a*, 66*b* and 66*c* representing first, second and third valve positions. The directional valve 66 may be proportional such that the directional valve 66 can assume positions intermediate of the first, second and third valve positions. In the first position, the active portion of the directional valve 66 is portion 66*a*. By selecting portion 66*a*, the directional valve 66 in the first position fluidly connects the lift chamber 52 to the source of pressurized fluid 79. Simultaneously the lowering chamber 54 may be fluidly connected to the low pressure region 72.

By selecting a second position of the directional valve 66 and thereby using the second portion 66*b*, the lowering chamber 54 is fluidly connected to the source of pressurized fluid 79 while the lift chamber 52 may be fluidly connected to the low pressure region 72.

By selecting a third position of the valve arrangement 66 and thereby using the third portion 66*c*, the lift and lowering chambers 52 and 54 may both be disconnected from both the source of pressurized fluid 79 and the low pressure region 72.

In an embodiment the directional control valve arrangements 66 and 166 may be the same valve.

The machine 10 may be provided with a control arrangement 90, for example an electronic control arrangement, for controlling one or more functions of the machine 10. In an embodiment the control arrangement 90 may be one or more electronic control units and/or one or more relay based system. It may for example be configured to receive and process signals and/or instructions from an input means 92. In an embodiment, the input means 92 may include multiple operator controls such as a joystick or switch arrangements. In an embodiment the input means 92 may be used to select one or more settings associated with at least one ride control setting. In an embodiment the control arrangement may be configured to receive and process a signal from a first sensing arrangement 93. The first sensing arrangement sensor 93 may be any type of equipment capable of providing an indication of a speed of the machine 10. In an embodiment the first sensing arrangement 93 may include a radar arrangement for detecting ground speed. In another embodiment the first sensing arrangement may include sensor for measuring a velocity parameter of the machine itself, such as, for example, an angular speed of a rotating component such as a transmission shaft.

In an embodiment the machine 10 may further be provided with a second sensing arrangement (not shown) for providing data regarding the loading of either or both of the first and second work arms 22 and 30. The second sensing arrangement may, for example, include one or more pressure sensors configured to measure fluid pressures associated with any of the first and second cylinders 26 and 33. In an embodiment, the second sensing arrangement may include sensors capable of measuring deflection of components of the machine 10. For example strain gauges (not shown) may provide an indication about the deflection of, for example, a portion of the first connection 21 and/or the second connection 29.

In an embodiment wherein the fluid system 50 is fitted onto the machine 10, the machine 10 may be configured to prevent pressurization of at least one of the lift and lowering chambers 52 and 54 via the directional valve 66 when the ride control valve 60 is in the first position. For example, the machine 10 may use the a control arrangement 90 for controlling the directional valve 22 and the ride control valve 66.

In an embodiment the control arrangement 90 may be configured to provide for an interlock between the actuators 80 and 86. If for example one of the actuators 86 is actuated, the control arrangement 90 may be configured to prevent any of the actuators 80 from being actuated. In an embodiment the input means 92 may include separate controls to separately control the fluid circuits associated with the first and second cylinders 26 and 33. In an embodiment the input means 92 may include combined controls for the fluid circuits associated with the first and second cylinders 26 and 33.

In an embodiment wherein the fluid system 50 is fitted onto the machine 10, the machine 10 may be configured to prevent at least one of the lift and lowering chambers 52 and 54 to be fluidly connected with at least one of the low pressure region 72 or the first accumulator 74 when the directional valve 66 is in the first or the second position. This may again be achieved via the control arrangement 90 which can be configured to prevent or enable certain combinations of simultaneous actuation of any of the actuators 80 with any of the actuators 86.

In an embodiment wherein the fluid system 50 is fitted onto the machine 10, the machine 10 may be configured to enable pressurization of at least one of the lift and lowering chambers 52 and 54 via the directional valve 66 when the ride control valve 60 is in the first position. This may, for example, be achieved by enabling the directional valve 66 to assume an intermediate position between the first and the third position, i.e. intermediate of the portions 66*a* and 66*c*, such that the fluid line 73 is fluidly connected with the fluid line 68, but that the fluid line 75 is not yet fluidly connected with the fluid line 70.

In an embodiment wherein the fluid system 50 is fitted onto the machine 10, the machine 10 may be configured to prevent pressurization of at least one of the lift and lowering chambers 52 and 54 via the directional valve 66 when the ride control valve 60 is in the second position.

In an embodiment wherein the fluid system 50 is fitted onto the machine 10, the machine 10 may be configured to enable pressurization of at least one of the lift and lowering chambers 52 and 54 via the directional valve 66 when the ride control valve 60 is in the second position. This may, for example, be achieved by placing the directional valve 66 in the first or second position.

Figure 3:
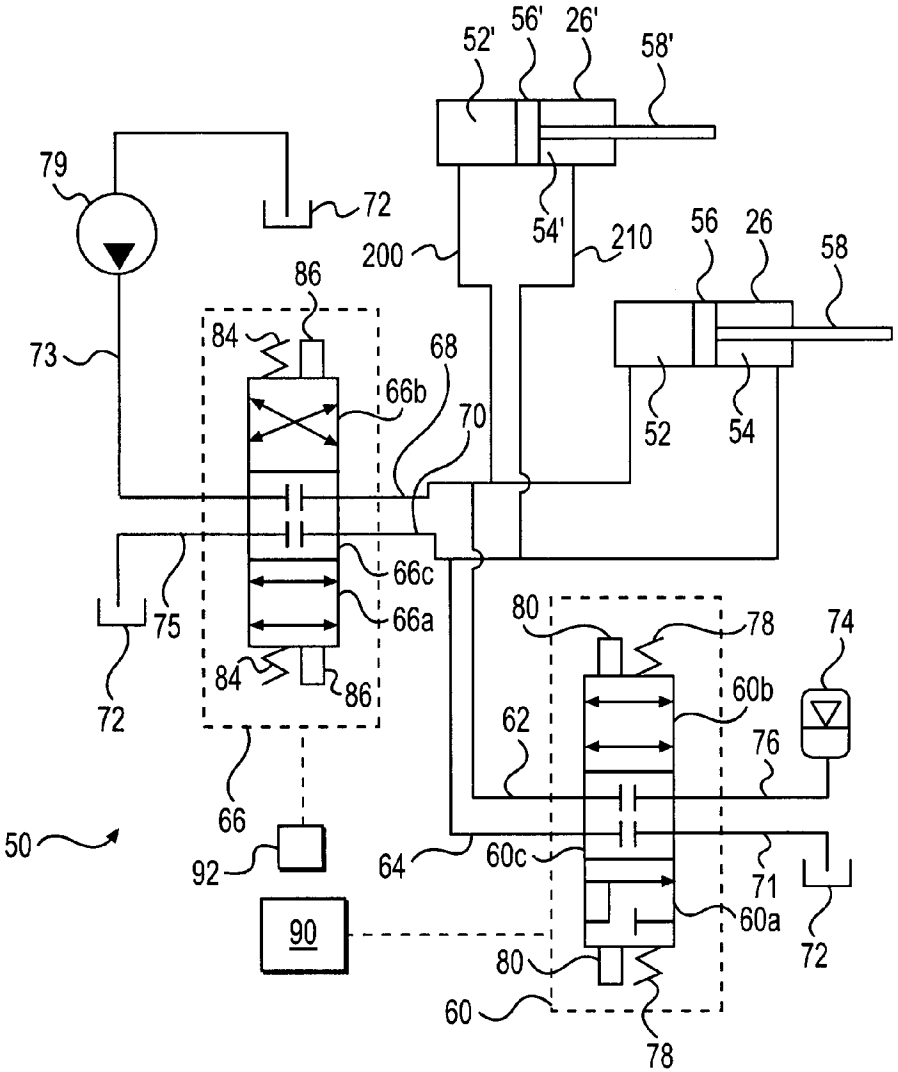
FIG. 3 is an exemplary schematic representation of a fluid system.

In some embodiments, machine 10, instead of being a backhoe loader, may be, for example, a loader, which may include one work arm, such as work arm 22 shown in FIG. 1. FIG. 3 illustrates a schematic of a fluid system 50 that may be employed for ride control of such a machine having one work arm (not shown). The fluid system 50 may include the first cylinder 26 and a second cylinder 26'. The first and second cylinders 26 and 26' may be disposed in parallel to each other, and may be operated together to actuate the work arm. The fluid system 50 may also include the ride control valve 60 and the directional valve 66.

The details of the first cylinder 26 and the directional valve 66 may be similar to those shown in FIG. 2, and are therefore not discussed in detail below. Similar to the embodiment shown in FIG. 2, the first lift chamber 52 of the first cylinder 26 may be fluidly connected to the ride control valve 60 via the fluid line 62. The first lowering chamber 54 may be fluidly connected to the ride control valve 60 via the fluid line 64. The first lift chamber 52 may further be connected to the directional valve 66 via the fluid line 68. The first lowering chamber 54 may further be fluidly connected to the directional valve 66 via the fluid line 70. The fluid lines 62 and 68 may be partially combined into a single fluid line as shown in FIG. 3, but they may also be run separately. Similarly, the fluid lines 64 and 70 may be partially combined into a single fluid line as shown in FIG. 3, but they may also be run separately.

The second cylinder 26' may be similar to the first cylinder 26, and may include a rod 58', and a piston 56' connected with the rod 58'. The second cylinder 26' may also include a second lift chamber 52' and a second lowering chamber 54'. The second lift chamber 52' may be fluidly connected with the ride control valve 60 through a fluid line 200 and the fluid line 62. The second lowering chamber 54' may be fluidly connected with the directional valve 66 through a fluid line 210 and the fluid line 70. In the embodiment shown in FIG. 3, the first lift chamber 52 and the second lift chamber 52' may share the fluid lines 62, 76, 68, and 73. The first lowering chamber 54 and the second lowering chamber 54' may share the fluid lines 70, 75, 64, and 71. Thus, first and second cylinders 26 and 26' may be operated simultaneously. It is also contemplated that the first and second cylinders 26 and 26' may be configured to be operated independently. When separated operated, the first and second cylinders 26 and 26' may be connected to ride control valve 60, directional valve 66, and accumulator 74 through separate fluid lines. Similar to the embodiment of FIG. 2, the ride control valve 60 may further be fluidly connected to the low pressure region 72 via the fluid line 71. The ride control valve 60 may further be connected to the accumulator 74 via the fluid line 76. The accumulator 74 may also be an arrangement of multiple accumulators. The ride control valve 60 may be further connected with the control arrangement 90.

Similar to the embodiment of FIG. 2, the directional valve 66 may further be fluidly connected to the low pressure region 72 via the fluid line 75. The directional valve 66 may further be connected to the source of pressurized fluid 79, which may be a pump, via the fluid line 73. The source of pressurized fluid 79 may be fluidly connected with the low pressure region 72. The directional valve 66 may be connected with the input means 92, which may be, for example, a joystick or a switch. The directional valve 66 may selectively direct pressurized fluid from the source of pressurized fluid 79 to the first and second lift and lowering chambers 52 (and/or 52') and 54 (and/or 54').

The control arrangement 90 may be configured to provide an interlock between the directional valve 66 and the ride control valve 60. For example, if one of the actuators 86 of directional valve 66 is actuated, the control arrangement 90 may be configured to prevent any of the actuators 80 of ride control valve 60 from being actuated. In an embodiment the input means 92 may include separate controls to separately control the fluid circuits associated with the first and second cylinders 26 and 33. In an embodiment the input means 92 may include combined controls for the fluid circuits associated with the first and second cylinders 26 and 26'.

Industrial Applicability

Referring to FIGS. 1-2, a machine such as exemplary machine 10 provided with an exemplary fluid system 50 may be used in mobile operations. During such operations the machine 10 may travel between multiple locations. Depending on factors, such as, for example, job requirements, distances to be traveled, surroundings and payload the operator may drive the machine 10 at a particular speed or within a range of speeds and with a particular payload associated with either of the first and second attachments 24 and 38. Under certain conditions the machine 10 may demonstrate a forward/rearward rocking action, which may be aggravated by conditions such as rough terrain, high speed travel or high payloads. This rocking motion may be aggravated by the inertia of the first and second work arms 22 and 30 relative to the rest of the machine 10.

Engaging ride control may prevent, overcome or alleviate at least some of the rocking motion as it may allow some of the energy involved a rocking movement to be absorbed by the accumulators 74 and/or 174. Ride control may be engaged by connecting at least one of the first and second cylinders 26 and 33 with at least one of the accumulators 74 and 174. This will enable a limited displacement of fluid from the first and second cylinders 26 and 33 to the accumulators 74 and 174 wherein energy carried by the displaced fluid may be used to compress the gas in the accumulators 74 and 174 thereby providing a balanced suspension effect for the first and second work arms 22 and 30.

For example, during operation it may be desirable to provide ride control to both the first and second work arms 22 and 30. Therefore, the fluid lines 62 and 76 between the lift chamber 52 of the first cylinder 26 and the first accumulator 74 may be opened to enable a transfer of fluid. At some stage which may happen before, during or after the opening of the fluid lines 62 and 76, the fluid lines 162 and 176 may be opened between the lift chamber 152 of the second cylinder 33 and second accumulator 74. These two events of connecting the first and second cylinders 26 and 33 with the accumulators 74 and 174 may take place before, during or after the machine 10 is moving in a selected direction.

During operation it may further be desirable to change the ride control setting, such as, for example, during a load-and-dig cycle in which the machine 10 may shuttle forwards and backwards to alternately dig and load. Such cycle may require extensive use of the first work arm 22, while the second work arm 30 may not be used, or used only to a limited extent. In such a situation it may be desirable to provide ride control, but it may be undesirable to connect the first cylinder 26 with the first accumulator 74. This may, for example, be undesirable if there is a risk of the digging being more difficult to perform or control, or a heavy payload on the work arm 22 creating a situation in which the first accumulator 74 may be near or exceeding its maximum capacity. In this scenario it may be desired to disable the fluid flow between the first cylinder and the first accumulator 74 but still enabling the fluid connection between the second cylinder 33 and the second accumulator 74.

In addition to the foregoing, the ride control settings may further be adjusted by selectively using one of the first and second portions 60*a* and 60*b* and one of the first and second portions 160*a* and 160*b* of the first and second ride control valves 60 and 160 respectively. Selecting, for example, the first portions 60*a* as the active portion may change the ride control characteristics of the system as compared to the situation in which the second portion 60*b* is the active portion, as not only the first accumulator 74 is connected to the lift chamber 52, but additionally the lift chamber 52 and the first accumulator 74 are fluidly connected to the lowering chamber 54. Depending on the characteristics of the machine 10, this may be experienced as the suspensive effect of the ride control being "harder" or "softer," i.e. changing the rate and/or amount of allowable travel of the work arm 22. It is to be understood that the aforementioned is equally applicable to the use of the first and second portions 160*a* and 160*b*.

In one operation it may be desired to disable ride control to at least one of the first and second work arms 22 and 30 when the first and second work arms 22 and 30 are operated by the directional control valves 66 and 166 respectively. This may be the case if it is desirable to have no interaction between the normal operations of the first and second work arms 22 and 30 and their respective ride controls.

In an embodiment the first sensing arrangement 93 may provide a signal indicative of the speed of the machine 10. The control arrangement 90 may be configured to automatically open at least one of the fluid line between the lift chamber 52 of the first cylinder 26 and the first accumulator 74, and the fluid line between the lift chamber 152 of the second cylinder 33 and the second accumulator 174 in response to detecting machine movement. In such an embodiment the ride control may be progressively engaged in relation to machine speed. For example, at low machine speed, the first lift chamber 52 and the first accumulator 74 may be fluidly connected. When the control arrangement 90 detects a higher machine speed, it may, for example, fluidly connect the first fluid chamber 52 to both the first accumulator 74 and the first lowering chamber 54. At subsequent events, such as, even higher machine speeds, the control arrangement 90 may then engage the second lift chamber 152, the second lowering chamber 154 and the second accumulator 174 in any order and as desired. It is to be understood that depending on machine configuration, it may be desirable to operate the various steps of the ride control system in a different order as described above. For example, in an embodiment it may be desired to first engage the portion of the fluid system associated with the second work arm 30. It may also be desirable to fluidly connect as a first step both a lift chamber 52, 152 and a lowering chamber 54, 154 with an accumulator 74, 174, rather than just fluidly connecting a lift chamber with an accumulator 74, 174.

In an embodiment, a load on either or both of the first and second work arms may be determined using the second sensing arrangement (not shown). Depending on the loading, the control arrangement 90 may simultaneously or sequentially engage the various possible options provided by the fluid system 50 for providing ride control to either or both the first and second work arms 22 and 30. For example, in a scenario wherein the machine 10 is loaded with a particular load associated with the first work arm 22, the control arrangement 90 may determine that only fluidly connecting the first cylinder 26 to the accumulator 74 may be desired. If then during driving, the control arrangement 90 determines the loading on the accumulator 74 is too high, the control arrangement 90 may decide to also fluidly connect the second cylinder 33 to the accumulator 174.

Referring to FIG. 3, in the embodiment where the machine 10 includes one work arm, ride control may be achieved through the fluid system 50, which may include one ride control valve 60, one directional valve 66, and one accumulator 74. Ride control may be engaged by connecting the cylinders 26 and/or 26' with the accumulator 74, which may enable an amount of fluid to be directed from the cylinders 26 and/or 26' to the accumulator 74. The energy carried by the displaced fluid may be used to compress the gas in the accumulator 74, thereby providing a balanced suspension effect for the work arm.

For example, when a load is applied to rod 58, the piston 56 may be pressed toward the first lift chamber 52, thereby reducing the volume of the first lift chambers 52 and increasing the pressure within the first lift chamber 52. The fluid lines 62 and 76 between the first lift chamber 52 of the first cylinder 26 and the accumulator 74 may be connected to enable a transfer of fluid, allowing fluid to be directed from the first lift chamber 52 to the accumulator 74, thereby reducing the pressure within the first lift chamber 52. Similar operations may be applicable to second cylinder 26'.

The control arrangement 90 may be configured to selectively connect or disconnect the fluid connection (e.g., the fluid lines 62 and 76) between the first lift chamber 52 and/or second lift chambers 52' and the accumulator 74, and to selectively connect or disconnect the fluid connection (e.g., the fluid lines 64 and 71) between the first lowering chambers 54 and/or second lowering chamber 54' and the low pressure region 72. For example, during operations, the control arrangement 90 may selectively connect or disconnect the fluid connection between the accumulator 74 and at least one of the first lift chamber 52 and the first lowering chamber 54. The control arrangement 90 may also selectively connect or disconnect the fluid connection between the accumulator 74 and at least one of the second lift chamber 52' and the second lowering chamber 54'. In some embodiments, the first and second cylinders 26 and 26' may be configured to be operated independently, for example, through independent fluid connections to the accumulator 74. In such embodiments, the control arrangement 90 may selectively connect or disconnect the fluid connections between the first cylinder 26 and accumulator 74, and the fluid connections between the second cylinder 26' and the accumulator 74 independently. Similar to the embodiment shown in FIG. 2, the ride control settings, such as "harder" and "softer" ride control characteristics, may be adjusted by selectively using one of the first and second portions 60*a* and 60*b*, which is not discussed in detail below.

It is to be understood that the machine 10 with the fluid system 50 may offer many options in ride control settings. In an embodiment the settings may be automatically adjusted by, for example, providing the interlocking arrangements as discussed above. In an embodiment the settings may be manually adjusted by enabling the operator to select between all possible options. In another embodiment the system may be semi-automatically controlled whereby, for example, the operator may select certain setting(s) but wherein the electronic control arrangements 90 may override some settings or suggest different settings.

It will be apparent to those skilled in the art that various modifications and variations can be made in the disclosed machine having selective ride control. Other embodiments will be apparent to those skilled in the art from consideration of the specification and practice of the disclosed embodiments herein. It is intended that the specification and examples be considered as exemplary only, with a true scope of the disclosure being indicated by the following claims.

What is claimed is:

1. A machine comprising:

a first work arm;

at least one first cylinder having a first lift chamber and a first lowering chamber, the first lift chamber being configured for receiving pressurized fluid so as to lift said first work arm;

a first accumulator associated with said first lift chamber of said first cylinder;

a second work arm;

at least one second cylinder having a second lift chamber configured for receiving pressurized fluid so as to lift said second work arm;

a second accumulator associated with said second lift chamber of said second cylinder;

a sensing arrangement configured to provide a signal indicative of machine travel speed; and a control arrangement configured to progressively fluidly connect one or both of said first and second accumulators with their associated lift chambers as a function of the signal, and to selectively connect both said first lift chamber and said first lowering chamber of said first cylinder to said first accumulator.

2. A machine according to claim 1, wherein said control arrangement is further configured to selectively fluidly disconnect one of said first and second lift chambers from the associated accumulator while maintaining the fluid connection between the other one of said first and second lift chambers and the associated accumulator.

3. A machine according to claim 1, wherein said second cylinder further includes a second lowering chamber and said control arrangement is further configured to selectively connect both said second lift chamber and said second lowering chamber of said second cylinder to said second accumulator.

4. A machine according to claim 3, wherein said machine further includes a first ride control valve for selectively fluidly connecting said first accumulator with the first lift chamber, a pump and a first directional valve arrangement for selectively directing pressurized fluid from said pump to said first lift and lowering chambers and wherein said control arrangement is further configured to provide an interlock between said first directional valve arrangement and said first ride control valve.

5. A machine according to claim 4, wherein said machine further comprises a second directional valve arrangement for selectively directing pressurized fluid from said pump to said second lift and lowering chambers and wherein said control arrangement is further configured to provide an interlock between said second directional valve arrangement and a second ride control valve.

6. A machine according to claim 1, wherein said machine further includes a first ride control valve for selectively fluidly connecting said first accumulator with the first lift chamber, a pump and a first directional valve arrangement for selectively directing pressurized fluid from said pump to said first lift and lowering chambers and wherein said control arrangement is further configured to provide an interlock between said first directional valve arrangement and said first ride control valve.

7. A machine according to claim 6, wherein said machine further comprises a second directional valve arrangement for selectively directing pressurized fluid from said pump to said second lift and lowering chambers and wherein said control arrangement is further configured to provide an interlock between said second directional valve arrangement and a second ride control valve.

8. The machine according to claim 1, wherein the control arrangement is configured to fluidly connect the first lift chamber with the first accumulator in response to a signal from the sensing arrangement indicative of a first machine travel speed, and to fluidly connect the first lift chamber with the first accumulator and with the first lowering chamber in response to a signal from the sensing arrangement indicative of a second machine travel speed greater than the first machine travel speed.

9. The machine according to claim 8, wherein the control arrangement is configured to fluidly connect the second lift chamber with the second accumulator in response to a signal from the sensing arrangement indicative of a third machine travel speed greater than the second machine travel speed.

10. The machine according to claim 1, wherein the second cylinder further comprises a second lowering chamber, the control arrangement being configured to fluidly connect the first lift chamber and the first lowering chamber with the first accumulator in response to a signal from the sensing arrangement indicative of a first machine travel speed, and to fluidly connect the second lift chamber and the second lowering chamber with the second accumulator in response to a signal from the sensing arrangement indicative of a second machine travel speed greater than the first machine travel speed.

11. A method of operating a machine having a first work arm associated with a first lift chamber of a first cylinder for lifting said first work arm, said first lift chamber of said first cylinder being selectively fluidly connectable to a first accumulator via a first fluid line, the machine further having a second work arm associated with a second lift chamber of a second cylinder for lifting said second work arm, said second lift chamber of said second cylinder being selectively fluidly connectable to a second accumulator via a second fluid line, the method comprising:

sensing a first machine travel speed;

opening said first fluid line between said first lift chamber of said first cylinder and said first accumulator in response to sensing the first machine travel speed;

sensing a second machine travel speed greater than the first machine travel speed; and opening said second fluid line between said second lift chamber of said second cylinder and said second accumulator in response to sensing the second machine travel speed.

12. A method according to claim 11, further comprising:

closing said first fluid line between said first lift chamber of said first cylinder and said first accumulator while keeping open said second fluid line between said second lift chamber of said second cylinder and said second accumulator.

13. A method according to claim 11, wherein said machine further includes a first directional valve for lifting and lowering said first work arm, the method further comprising closing said first fluid line between said first lift chamber of said first cylinder and said first accumulator when said first directional valve is operating to lift or lower said first work arm.

14. A method according to claim 13, wherein said machine further includes a second directional valve for lifting and lowering said second work arm, the method further comprising closing said second fluid line between said second lift chamber of said second cylinder and said second accumulator when said second directional valve is operating to lift or lower said second work arm.

15. A method according to claim 11, further comprising:

detecting that said machine is moving; and opening at least one of said first fluid line between said first lift chamber of said first cylinder and said first accumulator and said second fluid line between said second lift chamber of said second cylinder and said second accumulator in response to detecting machine movement.

16. A method according to claim 11, further comprising:

detecting that a load is placed on said machine; and opening at least one of said first fluid line between said first lift chamber of said first cylinder and said first accumulator and said second fluid line between said second lift chamber of said second cylinder and said second accumulator in response to detecting said load.

17. The method according to claim 11, further including fluidly connecting the first lift chamber with the first accumulator and a first lowering chamber of the first cylinder in response to sensing an additional machine travel speed, wherein the additional machine travel speed is greater than the first machine travel speed and less than the second machine travel speed.

18. The method according to claim 11, further including fluidly connecting the first lift chamber with the first accumulator and a first lowering chamber of the first cylinder in response to sensing the first machine travel speed.

19. A machine, comprising:

a work arm;

a first cylinder having a first lift chamber configured for receiving pressurized fluid, and a first lowering chamber, wherein when the first lift chamber is pressurized the first cylinder is extended;

a second cylinder having a second lift chamber configured for receiving pressurized fluid, and a second lowering chamber, wherein when the second lift chamber is pressurized the second cylinder is extended;

an accumulator associated with said first lift chamber of said first cylinder, and said second lift chamber of said second cylinder; and a control arrangement configured to selectively fluidly connect the accumulator with one or both of said first and second lift chambers and a sensing arrangement configured to provide a signal to the control arrangement indicative of machine travel speed, wherein the control arrangement is configured to fluidly connect the first lift chamber with the accumulator in response to a signal from the sensing arrangement indicative of a first machine travel speed, and to fluidly connect the first lift chamber with the accumulator and the first lowering chamber of the first cylinder in response to a signal from the sensing arrangement indicative of a second machine travel speed greater than the first machine travel speed.

20. A machine according to claim 19, further including a ride control valve located between the accumulator and at least one of said first and second said cylinders.

21. A machine according to claim 20, wherein said ride control valve is controlled by said control arrangement to selectively connect the accumulator with one or both of said first and second lift chambers.

22. A machine according to claim 20, further including a pump and a directional valve arrangement for selectively directing pressurized fluid from said pump to said first and second lift chambers, and wherein said control arrangement is further configured to provide an interlock between said directional valve arrangement and said ride control valve.

23. A machine according to claim 22, further including an input means associated with the directional valve arrangement.

24. The machine according to claim 19, wherein the control arrangement is configured to fluidly connect the second lift chamber with the accumulator in response to a signal from the sensing arrangement indicative of a third machine travel speed greater than the second machine travel speed.

* * * * *